US011298736B2

(12) United States Patent
Makabe

(10) Patent No.: US 11,298,736 B2
(45) Date of Patent: Apr. 12, 2022

(54) WRINKLE GENERATION DETECTING DEVICE, DIE CUSHION DEVICE AND DIE PROTECTION DEVICE, AND WRINKLE GENERATION DETECTING METHOD, DIE CUSHION FORCE AUTOMATIC SETTING METHOD AND DIE PROTECTING METHOD

(71) Applicant: AIDA ENGINEERING, LTD., Kanagawa (JP)

(72) Inventor: Junji Makabe, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 220 days.

(21) Appl. No.: 16/129,350

(22) Filed: Sep. 12, 2018

(65) Prior Publication Data

US 2019/0076905 A1 Mar. 14, 2019

(30) Foreign Application Priority Data

Sep. 12, 2017 (JP) ..... JP2017-174959

(51) Int. Cl.
*B21D 24/02* (2006.01)
*B21D 22/22* (2006.01)
(Continued)

(52) U.S. Cl.
CPC ..... *B21D 24/02* (2013.01); *B21D 22/22* (2013.01); *B21D 24/08* (2013.01); *B21D 24/14* (2013.01);
(Continued)

(58) Field of Classification Search
CPC ..... B21D 24/02; B21D 24/14; B21D 24/08; B21D 22/22; B21D 55/00; B21D 22/20; B30B 15/026; B30B 15/144; B21C 51/00
See application file for complete search history.

(56) References Cited

U.S. PATENT DOCUMENTS 8,037,735 B2 * 10/2011 Kohno ..... B21D 24/08 72/453.13
8,757,056 B2 * 6/2014 Kohno ..... B21D 24/14 100/50
(Continued)

FOREIGN PATENT DOCUMENTS

JP S62-134124 A 6/1987
JP H6-246364 A 9/1994
(Continued)

OTHER PUBLICATIONS

English translate (JP2006346742A), retrieved date Feb. 20, 2021.*
(Continued)

*Primary Examiner* — Adam J Eiseman
*Assistant Examiner* — Mohammed S. Alawadi
(74) *Attorney, Agent, or Firm* — McDemott Will & Emery LLP

(57) ABSTRACT

In a press machine having a die cushion device which supports a cushion pad and which generates a die cushion force when a slide of the press machine is lowered, the wrinkle generation detection device includes: a slide position detector which detects a height position of the slide; a cushion pad position detector which detects a height position of the cushion pad; and a computing unit which consecutively calculates a deviation between the height position of the slide detected by the slide position detector and the height position of the cushion pad detected by the cushion pad position detector, during a time period from the start of forming of a material by the slide lowering to the end of the forming, wherein a wrinkle generated in the material is detected based on an increase of the deviation consecutively calculated by the computing unit.

8 Claims, 12 Drawing Sheets

(51) Int. Cl.

| | |
|---|---|
| ***B21D 24/08*** | (2006.01) |
| ***B21D 24/14*** | (2006.01) |
| ***B30B 15/02*** | (2006.01) |
| ***B30B 15/14*** | (2006.01) |
| ***B21D 55/00*** | (2006.01) |
| ***B21C 51/00*** | (2006.01) |
| ***B21D 22/20*** | (2006.01) |

(52) U.S. Cl.
CPC ..... *B30B 15/026* (2013.01); *B30B 15/144* (2013.01); *B21D 55/00* (2013.01)

(56) References Cited

U.S. PATENT DOCUMENTS

| | | | | |
|---|---|---|---|---|
| 9,501,052 | B2 * | 11/2016 | Kohno | G05B 19/041 |
| 9,707,612 | B2 * | 7/2017 | Kohno | B30B 15/14 |
| 10,160,175 | B2 * | 12/2018 | Kohno | B30B 1/34 |
| 2007/0240479 | A1 * | 10/2007 | Nagai | B21D 22/22 72/348 |
| 2009/0071218 | A1 * | 3/2009 | Kohno | B21D 24/02 72/351 |
| 2009/0090161 | A1 * | 4/2009 | Amino | B21D 24/12 72/453.12 |
| 2010/0018280 | A1 * | 1/2010 | Maeda | B21D 22/26 72/358 |
| 2010/0089119 | A1 * | 4/2010 | Nagai | B21D 22/02 73/9 |
| 2010/0207566 | A1 * | 8/2010 | Iwashita | G05B 19/416 318/615 |
| 2014/0305177 | A1 * | 10/2014 | Kohno | G05B 19/041 72/21.4 |
| 2016/0184876 | A1 * | 6/2016 | Kondo | B30B 15/007 72/20.1 |
| 2016/0354828 | A1 | 12/2016 | Kohno | |
| 2017/0304887 | A1 * | 10/2017 | Kohno | B21D 24/02 |
| 2018/0104736 | A1 * | 4/2018 | McLaughlin | B21D 24/14 |

FOREIGN PATENT DOCUMENTS

| | | | | |
|---|---|---|---|---|
| JP | H8-281344 | A | | 10/1996 |
| JP | 2001-096314 | A | | 4/2001 |
| JP | 2001096314 | A | * | 4/2001 |
| JP | 2006-346742 | A | | 12/2006 |
| JP | 2006346742 | A | * | 12/2006 |
| JP | 2016-123985 | A | | 7/2016 |
| JP | 2016-221564 | A | | 12/2016 |
| WO | 2018/075347 | A1 | | 4/2018 |

OTHER PUBLICATIONS

English translate (JP2001096314A), retrieved date Feb. 20, 2021.*
Notification of Reasons for Refusal issued in corresponding Japanese Patent Application No. 2017-174959, dated Aug. 5, 2019, with English translation.
Extended European Search Report dated Feb. 12, 2019, issued in corresponding European Patent Application No. 18193746.7 (7 pages).

* cited by examiner

WRINKLE GENERATION DETECTING DEVICE, DIE CUSHION DEVICE AND DIE PROTECTION DEVICE, AND WRINKLE GENERATION DETECTING METHOD, DIE CUSHION FORCE AUTOMATIC SETTING METHOD AND DIE PROTECTING METHOD

CROSS-REFERENCE TO RELATED APPLICATIONS

The present application claims priority under 35 U.S.C. § 119 to Japanese Patent Application No. 2017-174959, filed on Sep. 12, 2017. The above application is hereby expressly incorporated by reference, in its entirety, into the present application.

BACKGROUND OF THE INVENTION

Field of the Invention

The present invention relates to a wrinkle generation detecting device, a die cushion device and a die protection device, and a wrinkle generation detecting method, a die cushion force automatic setting method and a die protecting method, and more specifically relates to techniques of detecting wrinkles generated in a material formed by a press machine.

Description of the Related Art

In a press machine having a die cushion device, when draw processing is carried out on a material, a wrinkle may be generated in a worked product if the die cushion force of the die cushion device is small.

Conventionally, if a wrinkle is generated in a product, an engineer changes the setting of the die cushion force in accordance with the condition of the product and the die structure and then confirms the product condition.

Japanese Patent Application Laid-Open No. 2001-96314 discloses a die cushion-based draw forming control device in which an appropriate die cushion pressure condition of draw forming can be easily set and the setting of the die cushion pressure condition can be changed based on the change in a forming speed in the middle of production.

Specifically, the die cushion-based draw forming control device disclosed in Japanese Patent Application Laid-Open No. 2001-96314 is provided with a wrinkle generation determining device which determines whether a wrinkle is generated in a formed product based on comparison between a desirable cushion pad position obtained from a slide position detected by a slide position detection device and an actual cushion pad position obtained by a cushion pad position detection device, at the end (completion) of an actual forming. Thereby, it is possible to automatically determine whether a formed product is a good product or a defective product for product classification based on the determination result by the wrinkle generation determining device, and to sort the good product.

Further, Japanese Patent Application Laid-Open No. 2001-96314 describes that if the wrinkle generation determining device determines that a wrinkles is generated, the die cushion pressure in a subsequent draw forming cycle is increased by a predetermined amount.

SUMMARY OF THE INVENTION

The decision for setting the die cushion force in order to prevent the generation of wrinkles in a product requires advanced knowledge and experience. Furthermore, because try-and-error attempts are repeated for the decision, there are additional problems that a lot of scrap products are produced and much adjustment time is necessary. In addition, there is a possibility of a die breakage if the press machine is operated without stopping in such a state that a wrinkle is generated in a product.

On the other hand, the wrinkle generation determining device described in Japanese Patent Application Laid-Open No. 2001-96314 determines whether or not a wrinkle is generated in a formed product based on the comparison between the desirable cushion pad position obtained from the slide position and the actual cushion pad position at the end of the actual forming. Therefore, it is possible to immediately sort a formed product as a good product or a defective product and to change the setting of the die cushion pressure by increasing the die cushion pressure in the subsequent draw forming cycle by a predetermined amount. However, it is not possible to consecutively detect the status of wrinkle generation over a time period from the start of forming of a material to the end of the forming.

As a result therefor, it is not possible to automatically control the die cushion force during the forming so as not to produce a defective product due to the generation of a wrinkle. Further, there are problems that it is not possible to obtain information on a position of the slide or a position of the cushion pad at a time point when a wrinkle is initially generated as information to be used in adjusting the die cushion force, etc., or it is not possible to emergently stop the press machine (slide) in order to prevent a die breakage due to the generation of wrinkle.

The present invention has been implemented in view of the circumstances described above, and aims to provide a wrinkle generation detection device, a die cushion device and a die protection device, and a wrinkle generation detecting method, a die cushion force automatic setting method and a die protecting method, each of which can consecutively detect the status of wrinkle generation during a time period from the start of forming of a material to the end of the forming.

In order to achieve the above object, one aspect of the present invention is a wrinkle generation detection device for a press machine having a die cushion device which supports a cushion pad and generates a die cushion force when a slide of the press machine is lowered, the wrinkle generation detection device comprising: a slide position detector configured to detect a height position of the slide; a cushion pad position detector configured to detect a height position of the cushion pad; and a computing unit configured to consecutively calculate a deviation between the height position of the slide detected by the slide position detector and the height position of the cushion pad detected by the cushion pad position detector, during a time period from a start of forming of a material by the slide lowering to an end of the forming, wherein a wrinkle generated in the material is detected based on an increase of the deviation consecutively calculated by the computing unit.

According to one aspect of the present invention, it is possible to consecutively detect wrinkles generated in the material during a time period from the start of forming of a material to the end of the forming.

In a wrinkle generation detection device according to another aspect of the present invention, it is preferable that the cushion pad position detector is provided at each of a plurality of spots of the cushion pad and detects each of height positions at the plurality of spots of the cushion pad, and that the computing unit calculates each of deviations between the height position of the slide detected by the slide position detector and the height positions at the plurality of spots of the cushion pad detected by each cushion pad position detector.

This makes it possible to detect the position in the material and slide position when wrinkles are initially generated.

A yet another aspect of the present invention is a die cushion device including: a die cushion force generator configured to generate a die cushion force in a cushion pad; a die cushion force automatic command unit configured to output a die cushion force command; a die cushion force controller configured to control the die cushion force generator such that the die cushion force generated in the cushion pad based on the die cushion force command corresponds to the die cushion force command; and the above-mentioned wrinkle generation detection device, wherein the die cushion force automatic command unit outputs a preset die cushion force command. Further, when an increase of the deviation is detected by the wrinkle generation detection device, the die cushion force automatic command unit increases the die cushion force command being presently outputted, and when the increase of the deviation is stopped, the die cushion force automatic command unit stops the increase of the die cushion force command.

According to yet another aspect of the present invention, it is possible to automatically control the die cushion force according to the detection results of the wrinkle generation detection device during the forming of a material and to prevent the forming of a defective product having wrinkles therein.

In a die cushion device according to a yet further aspect of the present invention, it is preferable that the die cushion force automatic command unit increases the die cushion force command being presently outputted within a range of a permissible die cushion force when the increase of the deviation is detected by the wrinkle generation detection device.

In the die cushion device according to a yet further aspect of the present invention, it is preferable to provide an output section which visually outputs or a storage section which stores, information on the position of the slide or the position of the cushion pad when the increase of the deviation is detected by the wrinkle generation detection device, and the die cushion force command increased by the die cushion force automatic command unit. This makes it possible to effectively utilize visually outputted information or information stored in a storage section in order to adjust a die cushion force, etc.

In the die cushion device according to a yet further aspect of the present invention, it is preferable to provide: an increase detector configured to detect the increase of the deviation calculated by the computing unit; and an emergency stop device configured to immediately stop the slide when the increase of the deviation is detected by the increase detector and the detected increment exceeds a permissible value. When wrinkles become large despite increasing of the die cushion force and if the die cushion force exceeds the permissible value, the slide is emergency stopped to protect the die.

In the wrinkle generation detection device according to a yet further aspect of the present invention, it is preferable to provide: an increase detector configured to detect the increase of the deviation calculated by the computing unit; and an output section configured to visually output, or a storage section configured to store, information on the position of the slide or on the position of the cushion pad at a time when at least an increase of the deviation is detected.

According to a yet further aspect of the present invention, information on the position of the slide or on the position of the cushion pad at a time when at least wrinkle generated in a material (increase of deviation) is initially detected is visually outputted or stored, and thereby enabling to effectively utilize the information to adjust a die cushion force, etc.

The die protection device according to a still further aspect of the present invention, is provided with: the above-mentioned wrinkle generation detection device; an increase detector configured to detect the increase of the deviation calculated by the computing unit; and an emergency stop device configured to immediately stop the slide when the increase of the deviation is detected by the increase detector.

According to a still further aspect of the present invention, when generation of wrinkle (increase of deviation) in a material is initially detected, the press machine (slide) is immediately stopped, and thereby enabling to previously prevent a die breakage due to the generation of large wrinkle.

The invention according to a yet further aspect is a wrinkle generation detecting method for a press machine having a die cushion device which supports a cushion pad and generates a die cushion force when a slide of the press machine is lowered, the method comprising the steps of: detecting a height position of the slide; detecting a height position of the cushion pad; and consecutively calculating a deviation between the detected height position of the slide and the detected height position of the cushion pad, during a time period from a start of forming of a material by the slide lowering to an end of the forming, wherein a wrinkle generated in the material is detected based on an increase of the deviation consecutively calculated.

The invention according to a still further aspect is a die cushion force automatic setting method, using the above-mentioned wrinkle generation detecting method, for a die cushion device which generates in the cushion pad a die cushion force corresponding to a die cushion force command based on a die cushion force command, the method comprising the steps of: outputting a preset die cushion force command, to a die cushion force generator configured to generate a die cushion force in the cushion pad; determining whether a deviation between the height position of the slide and the height position of the cushion pad is increased; increasing the die cushion force command being presently outputted, if it is determined that the deviation between the height position of the slide and the height position of the cushion pad is increased, from a time when the deviation is increased; and stopping the increasing of the die cushion force command, if it is determined that an increase of the deviation is stopped after the die cushion force command is increased.

According to a further aspect of the present invention, if it is determined that the deviation between the height position of the slide and the height position of the cushion pad is increased during the forming of a material by the wrinkle generation detecting method, the die cushion force is automatically controlled, and thereby enabling to prevent the generation of a wrinkle that could possibly lead to a defective product.

In the wrinkle generation detecting method according to still another aspect of the present invention, it is preferable to further include the steps of: detecting an increase of the deviation between the height position of the slide and the height position of the cushion pad; and visually outputting, or storing, information on the position of the slide or on the position of the cushion pad at a time point when at least an increase of the deviation is detected.

The invention according to a still further aspect is a die protecting method of protecting a die of the press machine, using the above-mentioned wrinkle generation detecting method, the die protecting method including the steps of: detecting an increase of a deviation between the height position of the slide and the height position of the cushion pad; and immediately stopping the slide when the increase of the deviation is detected.

According to the still further aspect of the present invention, when a wrinkle generated in a material (increase of deviation) is initially detected, the press machine (slide) is immediately stopped, and thereby, enabling to previously prevent a die breakage due to the generation of large wrinkle.

According to the present invention, during a time period from the start of forming of a material to the end of the forming, it is possible to consecutively detect the status of wrinkle generation. The detection results can be effectively utilized in controlling a die cushion force, in setting a die cushion force, etc., or in protecting a die.

DETAILED DESCRIPTION OF THE EMBODIMENTS

In accordance with the accompanying drawings, embodiments of a wrinkle generation detection device, a die cushion device and a die protection device, and a wrinkle generation detecting method, a die cushion force automatic setting method and a die protecting method, according to the present invention will be described in detail below.

[Configuration of Press Machine with Die Cushion Device]

Figure 1:
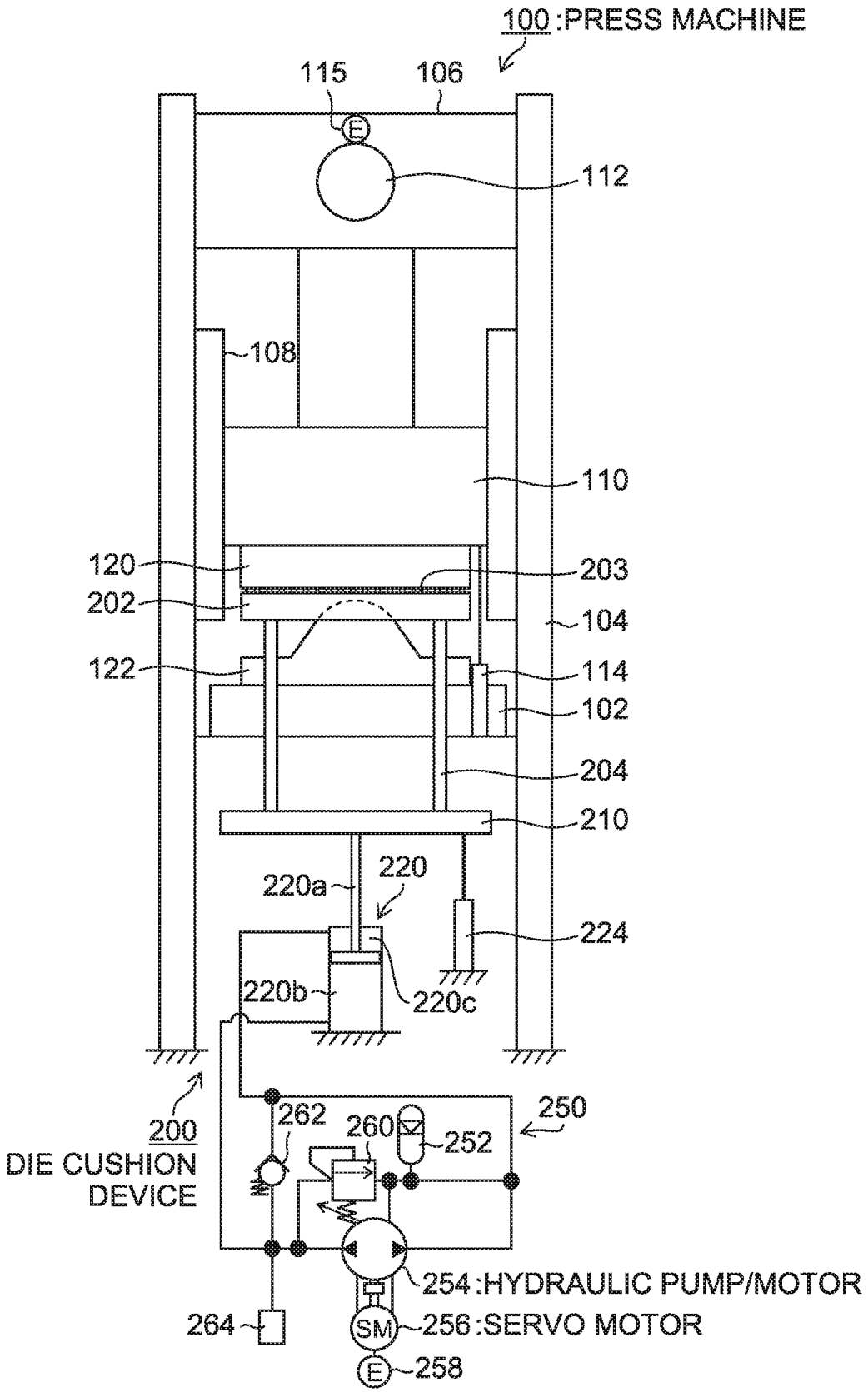
FIG. 1 is a configuration diagram illustrating a press machine provided with a die cushion device of a first embodiment to which a wrinkle generation detection device according to the present invention is applied.

FIG. 1 is a configuration diagram illustrating a press machine provided with a die cushion device of a first embodiment to which a wrinkle generation detection device according to the present invention is applied.

The press machine 100 illustrated in FIG. 1 has a frame which includes a bed 102, a column 104 and a crown 106. The press machine 100 has a slide 110 which is guided to be movable in a vertical direction by a guide 108 provided in the column 104. The slide 110 is moved upwards and downwards in FIG. 1 by a crank mechanism which includes a crank shaft 112 to which rotational driving force is transmitted from an unillustrated driving device.

A slide position detector 114 which detects a height position of the slide 110 is disposed on the bed's 102 side of the press machine 100. On the crank shaft 112, a crank shaft encoder 115 which detects angular velocity and an angle of the crank shaft 112 respectively is disposed.

An upper die 120 is mounted on the slide 110, and a lower die 122 is mounted on the bed 102 (or on a bolster of the bed 102).

A blank holder (or wrinkle pressing plate) 202 is disposed between the upper die 120 and the lower die 122. The lower side of the blank holder 202 is supported by a cushion pad 210 via a plurality of cushion pins 204. On the upper side of the blank holder 202, a material 203 to be formed is placed (in contact with the upper side of the blank holder 202).

<Structure of Die Cushion Device>

The die cushion device 200 according to a first embodiment of the invention mainly includes the blank holder 202, the cushion pad 210 which supports the blank holder 202 through the plurality of cushion pins 204, an hydraulic cylinder 220 which supports the cushion pad 210 and allows the cushion pad 210 to generate the die cushion force, a hydraulic circuit 250 which drives the hydraulic cylinder 220, and a die cushion control device 300 (FIG. 2) which controls a die cushion drive device 350 including the hydraulic circuit 250.

The hydraulic cylinder 220 and the hydraulic circuit 250 function as a cushion pad lifter which enables the cushion pad 210 to move up and down, and also function as a die cushion force generator which generates a die cushion force on the cushion pad 210.

Further, in relation to the hydraulic cylinder 220, a cushion pad position detector 224 is provided. The cushion pad position detector 224 detects a position of a piston rod 220*a* of the hydraulic cylinder 220 in an expansion and contraction direction, as a height position of the cushion pad 210. Note that, the cushion pad position detector may be disposed between the bed 102 and the cushion pad 210.

Next, a configuration of the hydraulic circuit 250 which drives the hydraulic cylinder 220 will be described.

The hydraulic circuit 250 includes an accumulator 252, an hydraulic pump/motor 254, a servo motor 256 connected to a rotating shaft of the hydraulic pump/motor 254, an angular velocity detector 258 which detects an angular velocity (servo motor angular velocity) of a driving shaft of the servo motor 256, a relief valve 260, a check valve 262, and a pressure detector 264.

The accumulator 252 in which a low gas pressure is set plays a role of a tank. The accumulator 252 and also plays a role of supplying oil substantially constant low-pressure having a substantially constant low-pressure to an upward side pressurization chamber (cushion pressure generation side pressurization chamber) 220*b* of the hydraulic cylinder 220 through the check valve 262 so as to allow a pressure to be easily increased at the time of controlling the die cushion force.

One of ports (discharge port) of the hydraulic pump/motor 254 is connected to the upward side pressurization chamber 220*b* of the hydraulic cylinder 220, and the other port is connected to the accumulator 252.

Note that, the relief valve 260 operates when abnormal pressure is generated (when die cushion force cannot be controlled and sudden abnormal pressure is generated) and is provided as a device which prevents damage on the hydraulic equipment. Further, a downward side pressurization chamber (pad side pressurization chamber) 220*c* of the hydraulic cylinder 220 is connected to the accumulator 252.

Pressure applied to the upward side pressurization chamber 220*b* of the hydraulic cylinder 220 is detected by the pressure detector 264, and the angular velocity of the driving shaft of the servo motor 256 is detected by the angular velocity detector 258.

[Principle of Die Cushion Force Control]

The die cushion force can be represented by the product of the pressure in the upward side pressurization chamber 220*b* with an area of the hydraulic cylinder 220. Therefore, controlling the die cushion force corresponds to controlling the pressure in the upward side pressurization chamber 220*b* of the hydraulic cylinder 220.

Now, assuming that hydraulic cylinder-die cushion pressure generation side sectional area: A hydraulic cylinder-die cushion pressure generation side volume: V die cushion pressure: P electric (servo) motor torque: T inertia moment of servo motor: I viscous resistance coefficient of servo motor: DM friction torque of servo motor: fM displacement volume of hydraulic motor: Q force to be applied to hydraulic cylinder piston rod from slide: $F_{slide}$ pad velocity generated by being pushed with the press: v inertia mass of hydraulic cylinder piston rod+pad: M viscous resistance coefficient of hydraulic cylinder: DS friction force of hydraulic cylinder: fS angular velocity of servo motor rotating by being pushed with pressure oil: ω volume elasticity coefficient of operating oil: K proportionality constants: k1, k2, a static behavior can be represented by equations (1) and (2).

$$P=\int K((v\cdot A-k1\,Q\cdot\omega)/V)dt \quad (1)$$

$$T=k2\cdot PQ/(2\pi) \quad (2)$$

A dynamic behavior can be represented by equations (3) and (4) in addition to the equations (1) and (2).

$$PA-F_{slide}=M\cdot dv/dt+DS\cdot v+fS \quad (3)$$

$$T-k2\cdot PQ/(2\pi)=I\cdot d\omega/dt+DM\cdot\omega+fM \quad (4)$$

The above equations (1) to (4) mean that force transmitted from the slide 110 through the cushion pad 210 to the hydraulic cylinder 220 compresses the upward side pressurization chamber 220*b* of the hydraulic cylinder 220 to thereby generate a die cushion pressure. At the same time, the die cushion pressure allows the hydraulic pump/motor 254 to function as the oil hydraulic motor, and when the rotating shaft torque generated in the hydraulic pump/motor 254 resists the driving torque of the servo motor 256, the servo motor 256 is rotated and the pressure rise can be suppressed. After all, the die cushion pressure is determined depending on the driving torque of the servo motor 256.

Figure 2:
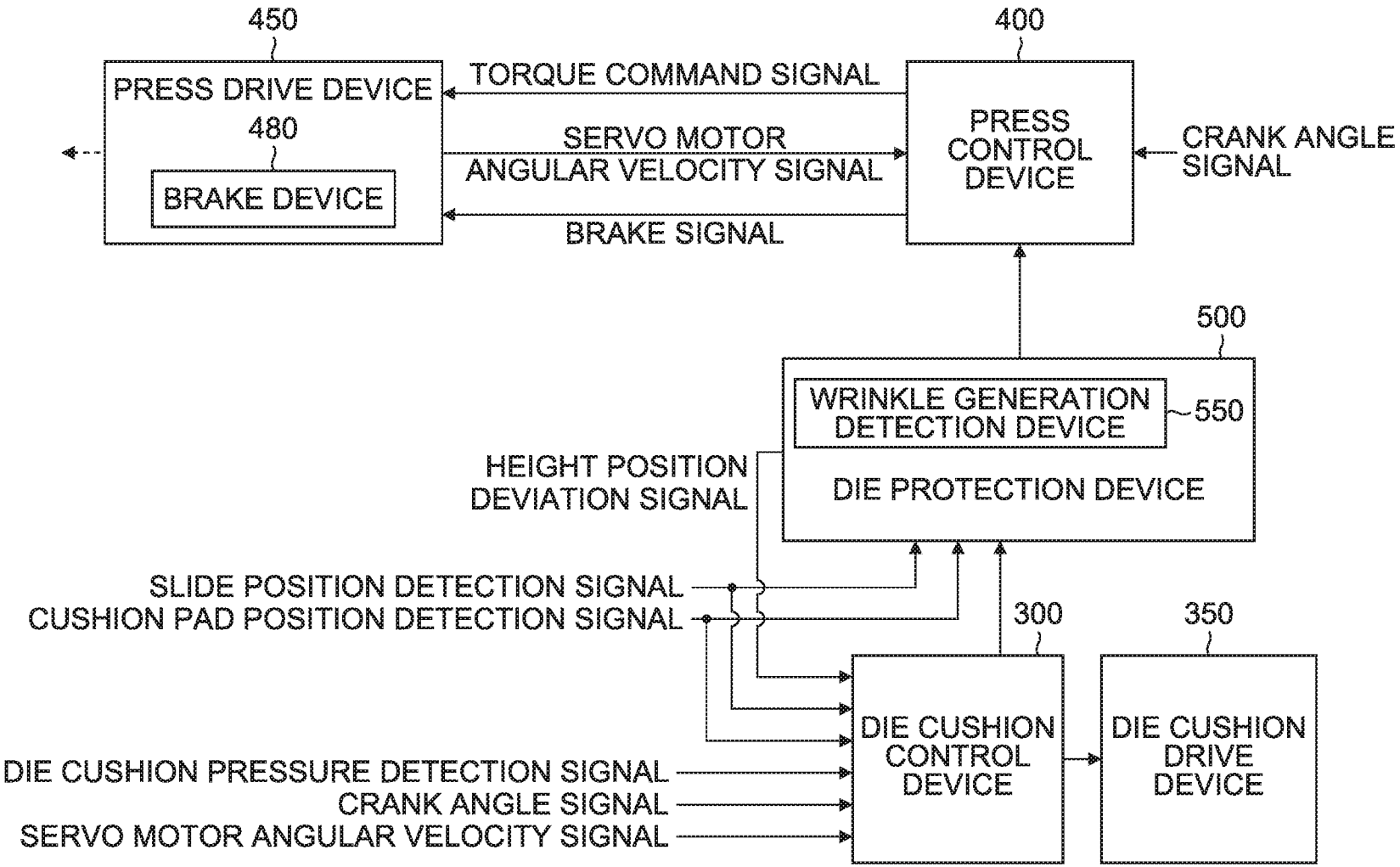
FIG. 2 is a block diagram illustrating a drive device and a control device for the entire press machine including the die cushion device.

FIG. 2 is a block diagram illustrating a drive device and a control device for the entire press machine 100 including a die cushion device 200, and also including a die protection device 500 and a wrinkle generation detection device 550 according to the present invention.

[Die Cushion Control Device]

In FIG. 2, a slide position detection signal which is detected by the slide position detector 114, a cushion pad position detection signal which is detected by the cushion pad position detector 224, a die cushion pressure detection signal which is detected by the pressure detector 264, a crank angle signal which is detected by the crank shaft encoder 115, a servo motor angular velocity signal which is detected by the angular velocity detector 258, and a height position deviation signal which represents the deviation between a height position of the slide 110 which is detected by the wrinkle generation detection device 550 and a height position of the cushion pad 210 are input to the die cushion control device 300. Note that, details of the height position deviation signal will be described later.

Figure 3:
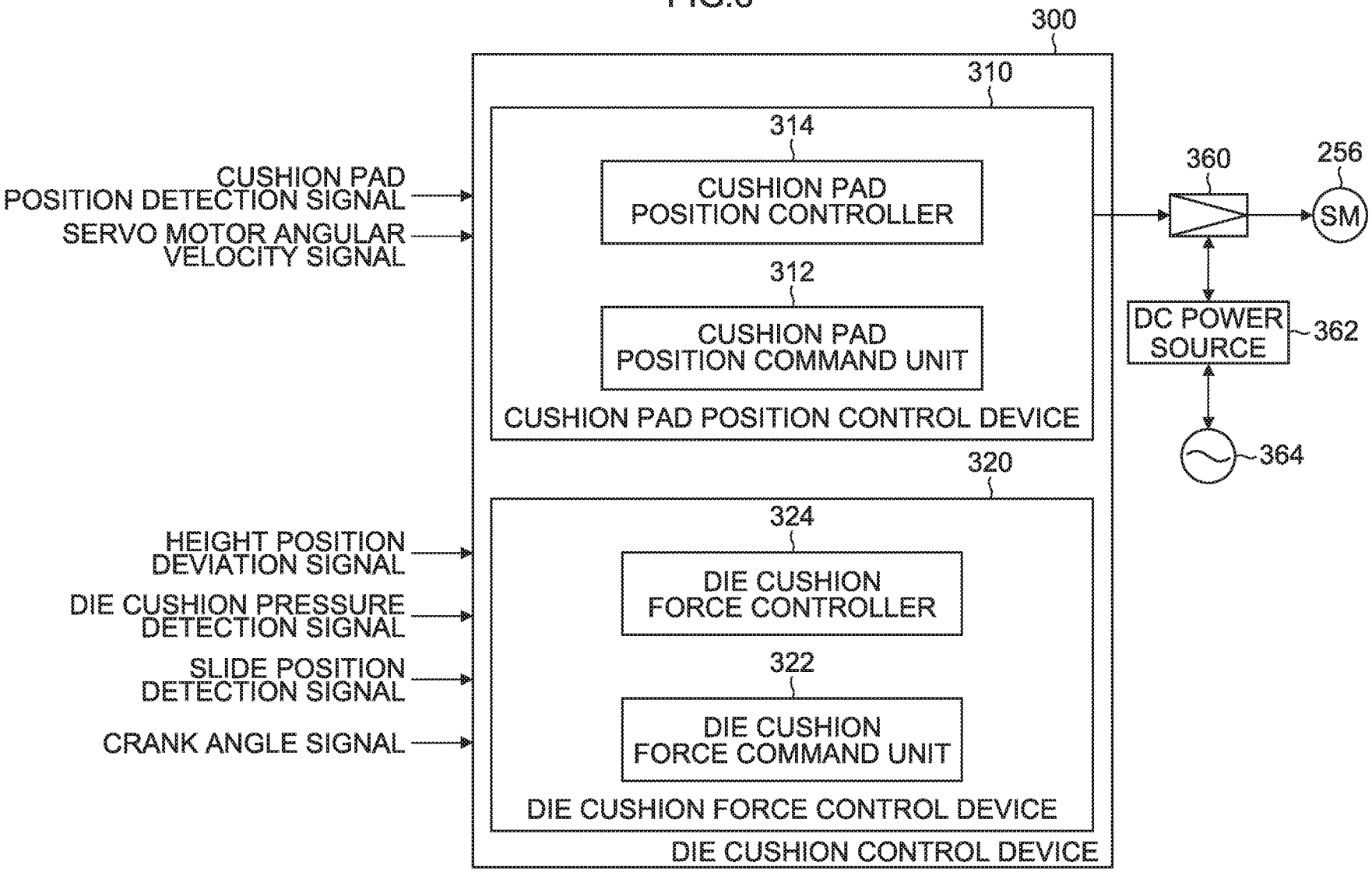
FIG. 3 is a block diagram illustrating a schematic structure of the die cushion control device shown in FIG. 2.

FIG. 3 is a block diagram illustrating a schematic structure of the die cushion control device 300 shown in FIG. 2.

As shown in FIG. 3, the die cushion control device 300 includes a cushion pad position control device 310 and a die cushion force control device 320.

The die cushion control device 300 determines whether the slide 110 is in a non-manufacturing process section or in a manufacturing process section on the basis of the crank angle signal inputted. In the case where the slide 110 is in the non-manufacturing process section, the die cushion control device 300 is switched to a cushion pad position control state. In the case where the slide 110 is in the manufacturing process section, the die cushion control device 300 is switched to a die cushion force control state.

<Control of Cushion Pad Position>

The cushion pad position control device 310 includes a cushion pad position command unit 312 and a cushion pad position controller 314.

A cushion pad position detection signal indicating the cushion pad position is output from the cushion pad position detector 224 to the cushion pad position command unit 312 in order that the cushion pad position command unit 312 uses the signal to generate an initial value for generating a position command. After the slide 110 reaches a bottom dead center and then the die cushion force control is completed, the cushion pad position command unit 312 outputs the cushion pad position command to control the height position of the cushion pad 210 in order that the product knockout operation is carried out and the cushion pad 210 is allowed to wait in a die cushion standby position, which is an initial position.

In the case of the cushion pad position control state, the cushion pad position controller 314, according to the cushion pad position command outputted from the cushion pad position command unit 312 and the cushion pad position detection signal detected by the cushion pad position detector 224, controls the servo motor 256 through an amplifier and PWM (Pulse Width Modulation) controller 360, which constitutes the die cushion drive device 350, to thereby supply the pressure oil from the hydraulic pump/motor 254 of the hydraulic circuit 250, which constitutes the die cushion drive device 350, to the upward side pressurization chamber 220*b* of the hydraulic cylinder 220.

By controlling the position of the piston rod 220*a* of the hydraulic cylinder 220 in the expansion and contraction direction, the height position of the cushion pad 210 (cushion pad position) can be controlled. Note that, it is preferable that the cushion pad position controller 314 controls the velocity of the servo motor 256 and controls the position of the cushion pad 210 in an up and down direction in order to ensure dynamic stability using the angular velocity signal of the driving shaft of the servo motor 256 detected by the angular velocity detector 258.

<Control of Die Cushion Force>

The die cushion force control device 320 mainly includes a die cushion force command unit 322 and a die cushion force controller 324.

A slide position detection signal detected by the slide position detector 114 is input to the die cushion force command unit 322 in order for the die cushion force command unit 322 to output a die cushion force command corresponding to the position of the slide 110.

Figure 8A:
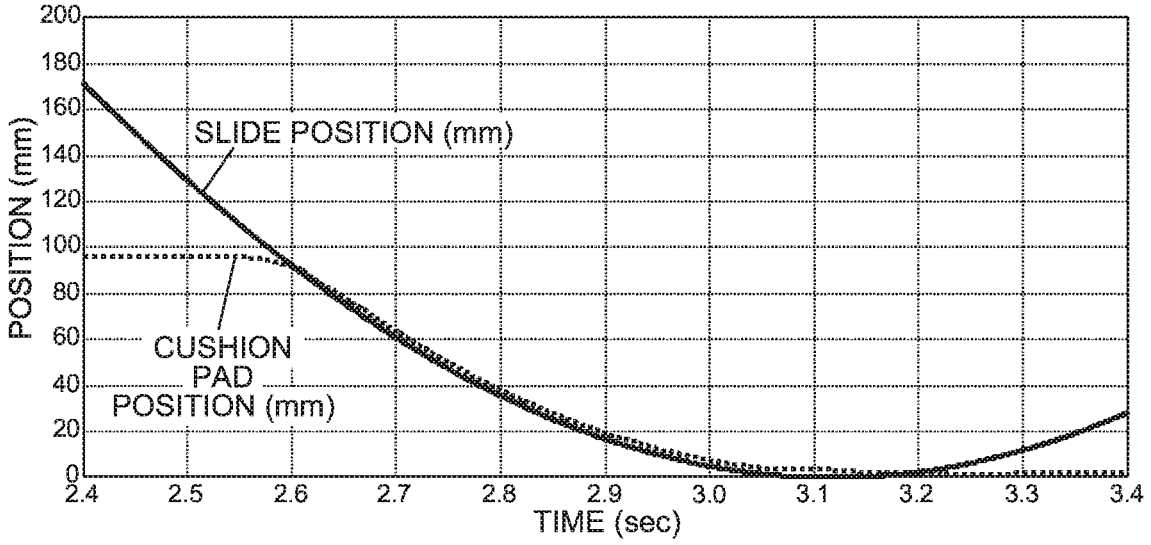
FIGS. 8A and 8B are waveform diagrams each illustrating a change of each physical quantity during a die cushion force is applied.
Figure 8B:
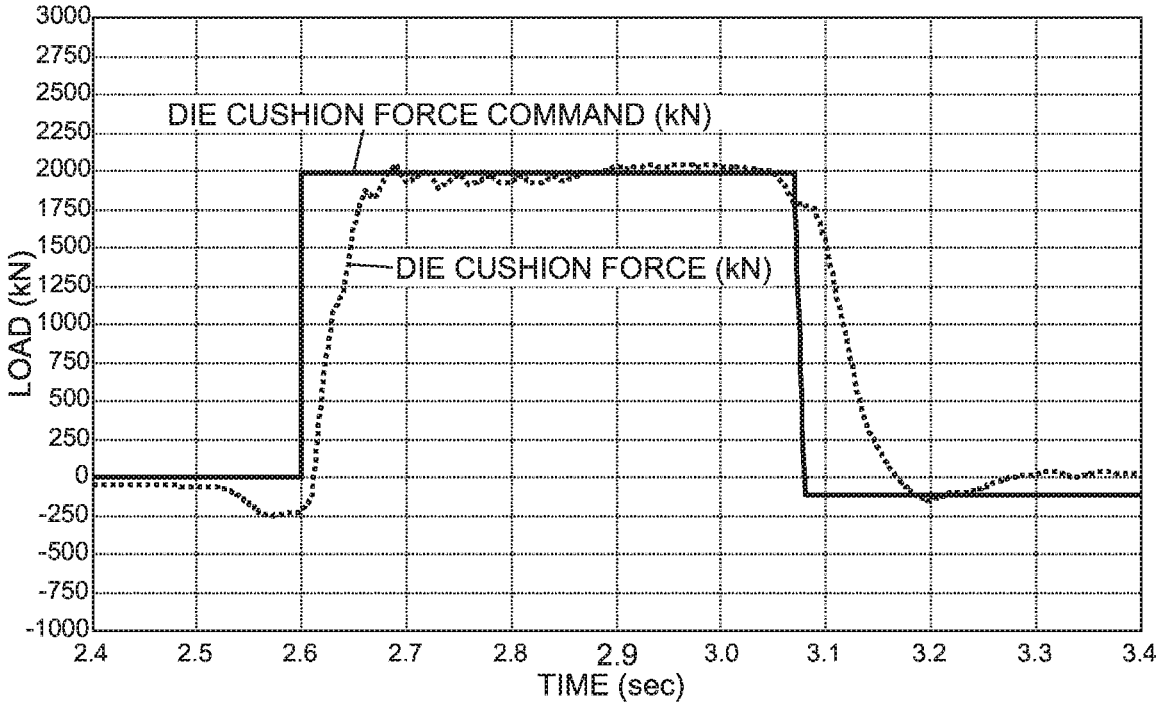

The die cushion force command unit 322 outputs a preset die cushion force command (in this example, a step-like die cushion force command shown in FIG. 8B), and controls the output timing, and so on, of the die cushion command based on the slide position detection signal.

Note that, it is possible to provide a timer (measuring instrument) which measures time within one cycle of the slide 110 (for example, time from a time point at which the slide 110 reaches a top dead center position detected by the crank angle signal), so that the die cushion force command unit 322 may receive a clocking signal indicating elapsed time after the slide 110 reaches the top dead center position from the timer and control the output timing of the die cushion force command and so on according to the clocking signal.

In order that the die cushion force controller 324 controls the die cushion force based on the die cushion force command input from the die cushion force command unit 322, a die cushion pressure detection signal indicating pressure of the upward side pressurization chamber 220*b* of the hydraulic cylinder 220, which is detected by the pressure detector 264, is inputted to the die cushion force controller 324. Further, the servo motor angular velocity signal indicating the angular velocity of the driving shaft of the servo motor 256, which is detected by the angular velocity detector 258, is inputted to the die cushion force controller 324 as an angular velocity feedback signal to ensure dynamic stability of the die cushion force.

When the cushion pad position (die cushion standby position (retention)) control state is switched to the die cushion force control state, the die cushion force controller 324 outputs a torque command obtained by computing using the die cushion force command, the die cushion pressure detection signal, and the servo motor angular velocity signal to the servo motor 256 through the amplifier and PWM controller 360, to perform the die cushion force control.

At the time of the die cushion force control, when the slide 110 moves down (during processing) from the time when the slide 110 collides with the material 203 (and the blank holder 202) until the time when it reaches the bottom dead center, an output direction and generation velocity of the torque of the servo motor 256 are inverted. That is, by power which the cushion pad 210 receives from the slide 110, the pressure oil is flowed into the hydraulic pump/motor 254 from the upward side pressurization chamber 220*b* of the hydraulic cylinder 220, and the hydraulic pump/motor 254 is operated to function as a hydraulic motor. By the hydraulic pump/motor 254, the servo motor 256 is driven so as to function as a generator. The electricity generated by the servo motor 256 is in turn regenerated for an AC power source 364 through the amplifier and PWM controller 360, and through a DC power source 362 having an electricity regeneration function.

Note that, in the first embodiment of the present invention, the die cushion force command unit 322 of the die cushion device functions as a die cushion force automatic command unit which automatically adjusts (sets) the preset die cushion force command according to the height position deviation signal detected by the wrinkle generation detection device 550. Details thereof will be described later.

[Wrinkle Generation Detection Device]

Figure 4:
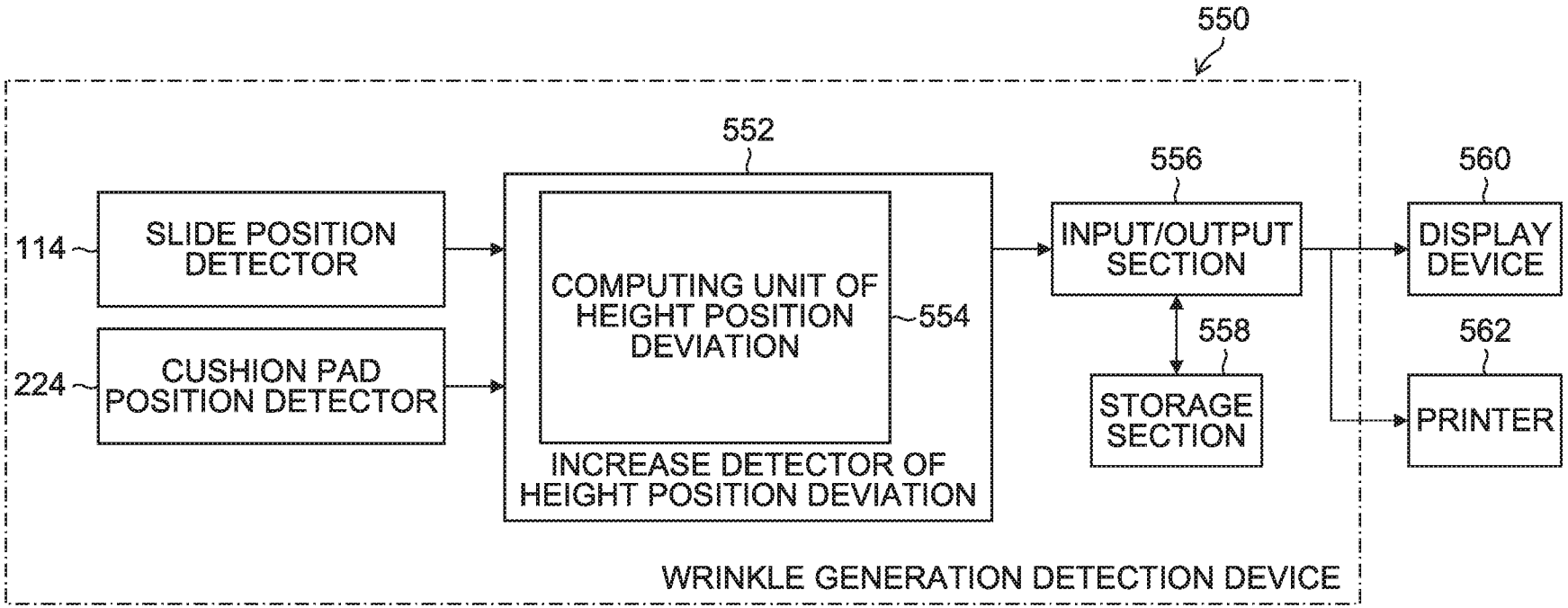
FIG. 4 is a block diagram illustrating an embodiment of the wrinkle generation detection device shown in FIG. 2.

FIG. 4 is a block diagram illustrating an embodiment of the wrinkle generation detection device 550 shown in FIG. 2.

As shown in FIG. 4, the wrinkle generation detection device 550 mainly includes a slide position detector 114, a cushion pad position detector 224, an increase detector 552 in height position deviation provided with a computing unit 554 for height position deviation, an input/output section 556, and a storage section 558.

The slide position detector 114 detects a height position of the slide 110 and then outputs a slide position detection signal indicating the detected height position of the slide 110 to the computing unit 554. The cushion pad position detector 224 detects a height position of the cushion pad 210 and outputs a cushion pad position detection signal indicating the detected height position of the cushion pad 210 to the computing unit 554. Note that those detectors provided for the die cushion device 200 can be used for the slide position detector 114 and the cushion pad position detector 224, respectively.

The computing unit 554, according to the slide position detection signal inputted from the slide position detector 114 and to the cushion pad position detection signal inputted from the cushion pad position detector 224, consecutively calculates a deviation between the height position of the slide 110 and the height position of the cushion pad 210 during a period from starting the forming of the material 203 by the down movement of the slide 110 until end of the forming, and outputs a height position deviation signal indicating the calculated deviation.

Figure 5B:
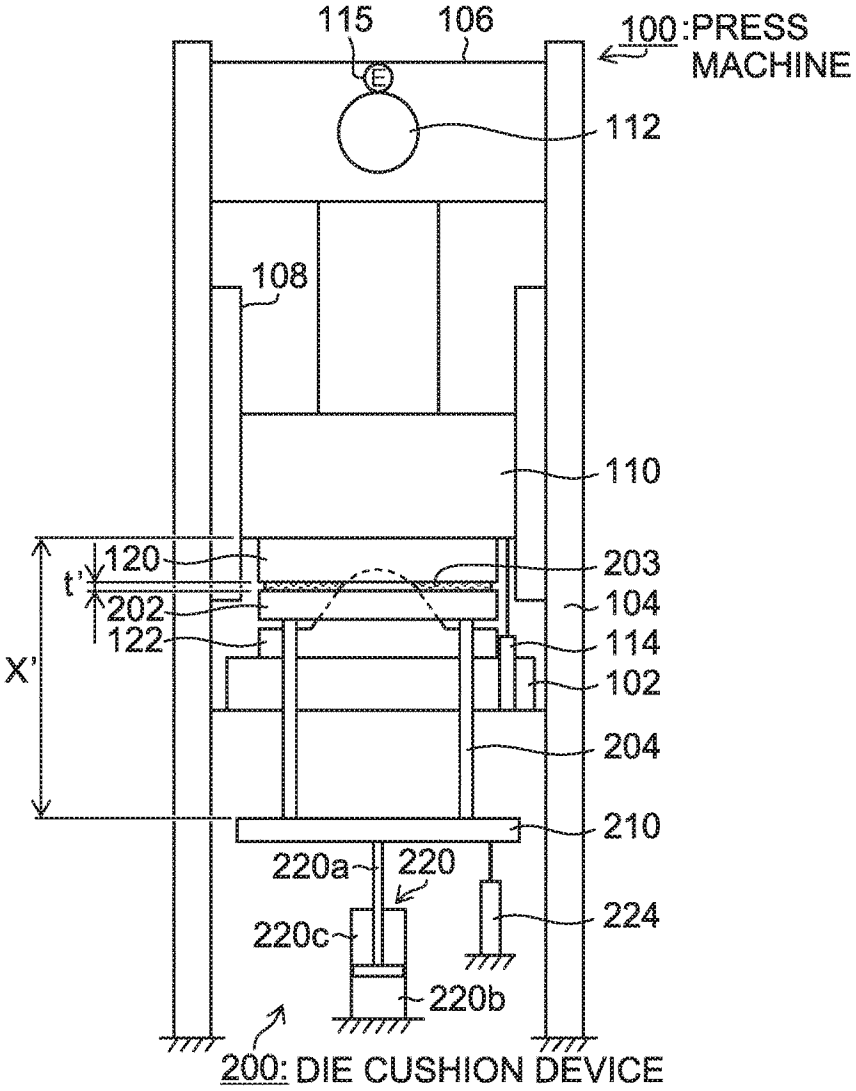
FIG. 5B is a diagram illustrating a state of the press machine shown in FIG. 1 when the forming of a material proceeds further and wrinkles are generated in the material.
Figure 5A:
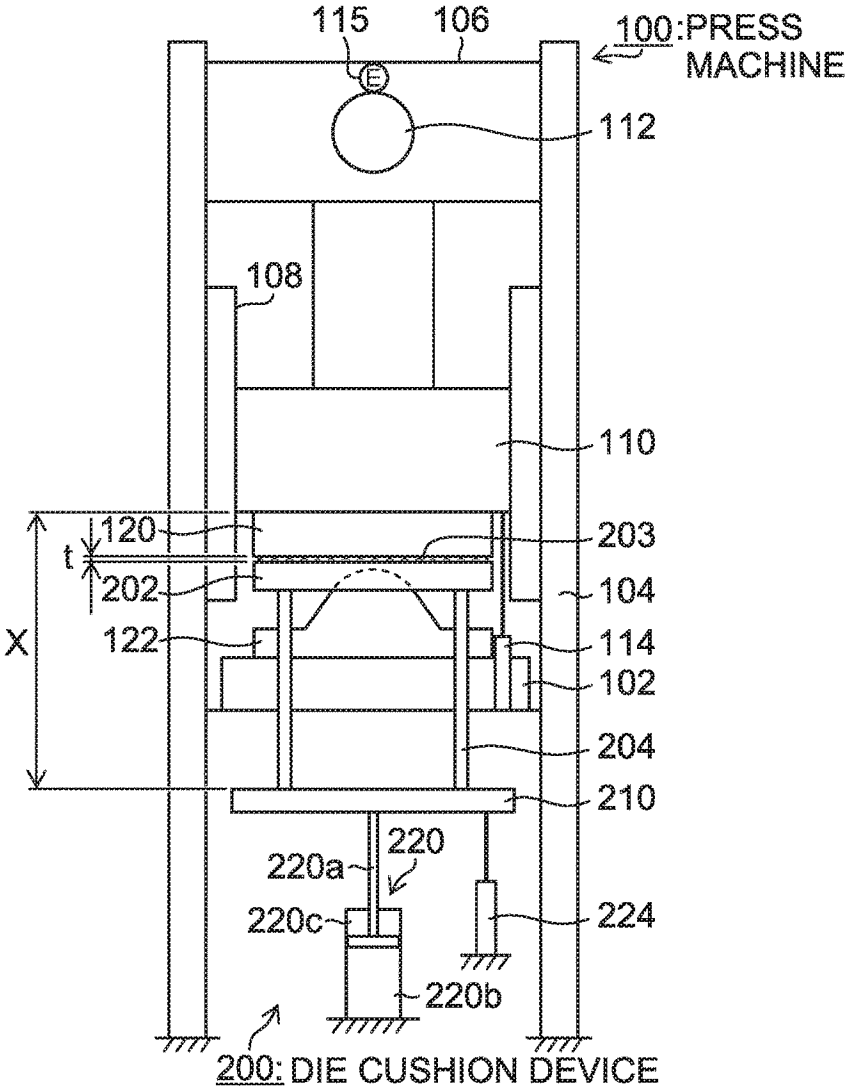
FIG. 5A is a diagram illustrating a state of the press machine shown in FIG. 1 at a moment when an upper die and a blank holder are brought into close contact with each other via a material.

FIG. 5A illustrates a state of the press machine 100 at the moment when the upper die 120 and the blank holder 202 are in tightly contact with each other via the material 203. FIG. 5B is a diagram illustrating a state of the press machine 100 when the forming of the material 203 proceeds further and wrinkles are generated in the material 203.

In the state illustrated in FIG. 5A, a distance X between the slide and the cushion pad is "a length of the cushion pin 204+a thickness of the blank holder 202+a thickness (t) of the material 203+a thickness of the upper die 120." In the state illustrated in FIG. 5B, a distance X' between the slide and the cushion pad is "a length of the cushion pin 204+a thickness of the blank holder 202+a thickness (t') of the material 203 including wrinkles+a thickness of the upper die 120." The values X and X' satisfy the relation of "X<X'."

During the draw forming, it is possible to detect generation of wrinkles by monitoring the difference between the height position of the slide 110 and the height position of the cushion pad and by estimating that generation of wrinkles in the material 203 causes increase of the thickness of the material 203 when the deviation (the slide position−the cushion pad position) between the slide height position and the cushion pad height position is increased.

Accordingly, from the deviation (an increase of the deviation) calculated by the computing unit 554, it is possible to detect wrinkles (wrinkle size) generated in the material 203.

Further, a signal indicating that the die cushion device 200 is in a cushion pad position control state or in a die cushion force control state is input from the die cushion control device 300 to the wrinkle generation detection device 550 (see FIG. 2). The wrinkle generation detection device 550 is only operable in the die cushion force control state. The wrinkle generation detection device 550 consecutively calculates a deviation between the height position of the slide 110 and the height position of the cushion pad 210 during a die cushion force control period (period from the start of forming until the end of the forming), and outputs the height position deviation signal indicating the calculated deviation.

The increase detector 552, according to the height position deviation signal output from the wrinkle generation detection device 550, detects an increase (increment) of the height position deviation during a period from the start of forming until the end of the forming, and outputs information on the position of the slide 110 or the position of the cushion pad 210 at a time point when at least the increase of the height position deviation is detected (at a time point when a wrinkle is initially generated). Note that, the time within one cycle of the slide 110 at a time point when the increase of the height position deviation is detected, may be provided as the information on the position of the slide 110.

Further, it is preferable that the increase detector 552 outputs information indicating an increment (increase amount) of the height position deviation during a period from the start of forming until the end of the forming, while relating it to the slide position.

An output section of the input/output section 556 is connectable to the display device 560 and a printer 562. The display device 560 or the printer 562 visually displays, or visually prints out on a printing paper through the output section, information relating to a position of the slide 110 or a position of the cushion pad 210 at a time point when at least the increase of the height position deviation is detected, which is outputted from the increase detector 552.

Further, the input/output section 556 is connectable to the storage section 558. Information on the position of the slide 110 or the position of the cushion pad 210 at a time point when at least the increase of the height position deviation detected by the increase detector 552 is detected, can be stored in the storage section 558 through the input/output section 556. Further, the information stored in the storage section 558 can be outputted to the display device 560 or the printer 562 through the input/output section 556. Note that, the storage section 558 may be an internal memory of the wrinkle generation detection device 550 or an external memory which is detachable to the wrinkle generation detection device 550.

Figure 6:
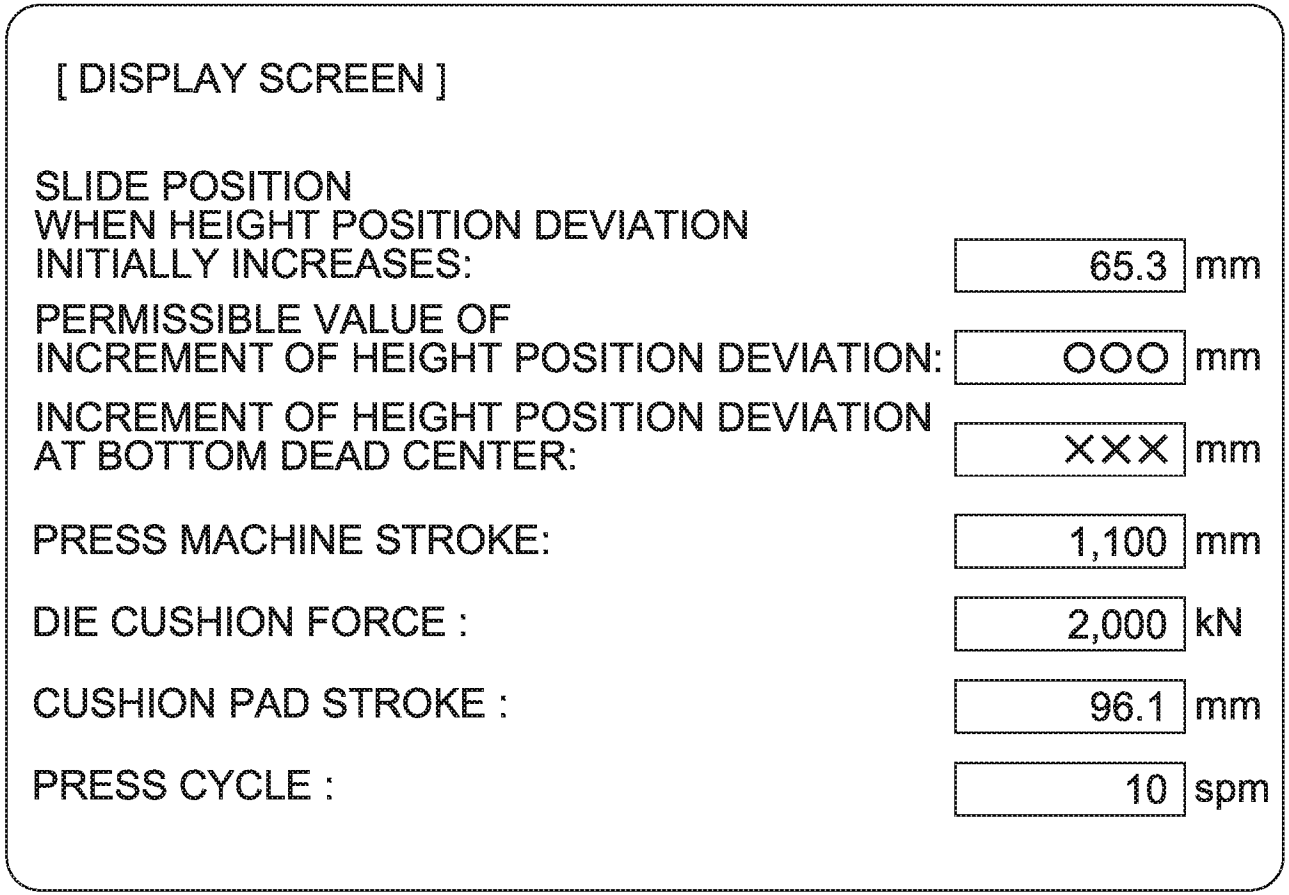
FIG. 6 is a diagram illustrating an example of a display screen of an indicator to which are output from the wrinkle generation detection device shown in FIG. 4.

FIG. 6 is a view illustrating an example of a display screen of the display device 560 shown in FIG. 4.

The display screen displays the slide position detected by the wrinkle generation detection device 550 (increase detector 552) when the height position deviation initially increases, a permissible value of the increment (wrinkle size) of the height position deviation, and the increment (final wrinkle size on the product) of height position deviation at the slide bottom dead center and, in addition thereto, operating condition of the press machine 100 (press machine stroke, die cushion force, cushion pad stroke, press cycle, etc.)

Note that, the increase detector 552 may be configured to output in association with the slide position, etc., information indicating the increment of the height position deviation during a period from the start of forming until the end of the forming irrespective of the time point when a wrinkle is initially generated. The information may be stored in the storage section 558 through the input/output section 556 or outputted to the display device 560 or the printer 562 through the input/output section 556.

The increment of the height position deviation is a value obtained by subtracting the thickness (t) of the material 203 without wrinkles from the thickness (t') of the material 203 including wrinkles. The increment of the height position deviation corresponds to the size of wrinkle generated in the material 203.

In the case that wrinkles are generated in the material 203, an engineer is able to use the information displayed on the display device 560 or printed out by the printer 562 (information including the slide position at a time point when a wrinkle is initially generated) in order to set the operating condition of the press machine 100, including the die cushion force (die cushion force command). Further, with the information which relates to an increment of the height position deviation (information corresponding to the size of wrinkle) outputted to the display device 560, etc., it is possible to also use the information corresponding to the size of wrinkle, as the information used for setting of the die cushion force command, etc.

[Die Protection Device]

The die protection device 500 shown in FIG. 2 includes the wrinkle generation detection device 550 and is provided with an emergency stop device which immediately stops the press machine 100 (slide 110) when the increment exceeds the permissible value based on the information indicating the increment of the height position deviation (wrinkle size) which is detectable by the wrinkle generation detection device 550 during a period from the start of forming until the end of the forming.

Now, it is preferable that the permissible value can be appropriately set by an engineer considering, for example, whether the size of wrinkle generated in the material 203 may cause damage on the die, or the die structure.

When the slide 110 needs to be immediately stopped, the die protection device 500 outputs a braking command for sudden braking to a press control device 400.

A crank angle signal is output to the press control device 400 from the crank shaft encoder 115. In addition, a servo motor angular velocity signal indicating an angular velocity of a servo motor 406 (FIG. 7) of a press drive device 450 is also output to the press control device 400. The press control device 400 generates a torque command signal based on the received crank angle signal and the received servo motor angular velocity signal so as to obtain a predetermined slide velocity or a predetermined crank shaft angular velocity. The press control device 400 outputs the generated torque command signal to the press drive device 450. Note that, the servo motor angular velocity signal is used as an angular velocity feedback signal for ensuring dynamic stability of the slide 110.

Further, the press control device 400 generates a torque command signal for applying a maximum torque in a braking direction to the press drive device 450 based on the braking command inputted from the die protection device 500, and further, outputs a signal for turning ON/OFF a brake device 480.

Figure 7:
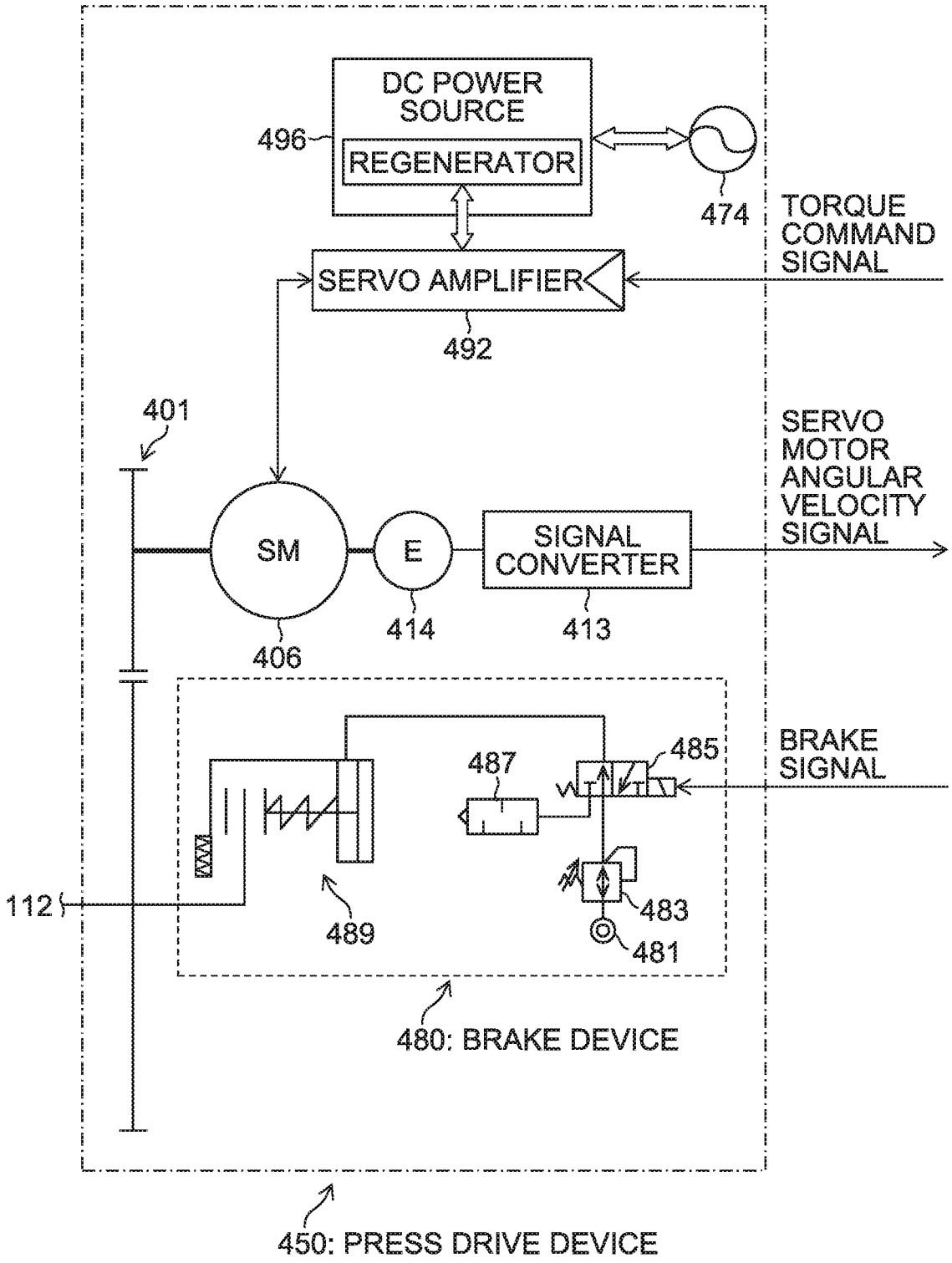
FIG. 7 is a configuration diagram illustrating an example of the press drive device shown in FIG. 2.

FIG. 7 is a configuration diagram illustrating an example of the press drive device 450 shown in FIG. 2.

The press drive device 450 functions as the drive device and the brake device for the press machine 100 (slide 110). The press drive device 450 mainly includes the servo motor 406, a reduction gear 401 which transmits a rotary driving force of the servo motor 406 to the crank shaft 112, and the brake device 480.

Driving power which corresponds to the torque command signal inputted from the press control device 400 is supplied to the servo motor 406 via the amplifier and PWM controller (servo amplifier) 492. The servo motor 406 is driven and controlled in order to obtain a predetermined (setting) slide velocity or a predetermined crank shaft angular velocity. Note that, electric power is supplied to the servo amplifier 492 from a DC (direct current) power source 496 having an electricity regeneration function. At the time of braking of the press machine 100 (slide 110), the electric power generated by the driving torque of the servo motor 406 acting in the braking direction is regenerated in an AC (alternative current) power supply 474 via the servo amplifier 492 and the DC power source 496.

Further, an encoder 414 is mounted on a rotating shaft of the servo motor 406. An encoder signal outputted from the encoder 414 is converted into a servo motor angular velocity signal by a signal converter 413, and then outputted to the press control device 400.

The brake device 480 has: a brake releasing solenoid valve 485 to which compression air is supplied from an air pressure source 481 via a pressure reducing valve 483; a brake mechanism 489; and a silencer 487.

A brake signal is output to the brake releasing solenoid valve 485 from the press control device 400 to control the turning ON/OFF of the brake releasing solenoid valve 485.

In the normal operation (operation without generation of wrinkles), the brake releasing solenoid valve 485 of the brake device 480 is turned ON thereby releasing braking. In contrast, when abnormality such as generation of wrinkles, etc., occurs (when emergency stopped), the slide 110 is suddenly braked by outputting the torque command signal for a direction opposite to the slide operation direction to the servo amplifier 492. After the press machine 100 (slide 110) is stopped (at almost same time point of the stop), the brake releasing solenoid valve 485 is turned OFF thereby applying braking.

Note that, even if the press machine is disabled to suddenly brake the slide 110 during forming, when wrinkles which lead to a defective product are generated, it is preferable to quickly stop the press machine in order to prevent production of a lot of defective products and to prevent die-breakage due to the continuous operation of the press machine under the state where wrinkles are generated.

[Wrinkle Generation Detecting Method and Die Cushion Force Automatic Setting Method]

Next, an embodiment of the wrinkle generation detecting method and die cushion force automatic setting method will be described.

The press machine 100 is operated under the following condition.

press machine stroke: 1,100 mm press cycle: 10 spm (spm: strokes per minute)

die cushion force: 2,000 kN die cushion stroke: 96.1 mm collision velocity (velocity at which the slide position reaches 96.1 mm): 350 mm/s FIGS. 8A and 8B are waveform diagrams each illustrating a change of each physical quantity during the die cushion force is applied under the above-mentioned operating condition. FIG. 8A is a waveform diagram illustrating the slide position and the cushion pad position. FIG. 8B is a waveform diagram illustrating the die cushion force command and the die cushion force response (die cushion load).

The die cushion force command unit 322 (FIG. 3) outputs a step-like die cushion force command (die cushion force command (2000 kN) in FIG. 8B) based on the slide position detection signal, during a forming time period from the start of forming of the material 203 (at the time of collision of the slide 110 against the material 203) to the end of the forming (bottom dead center).

Figure 9:
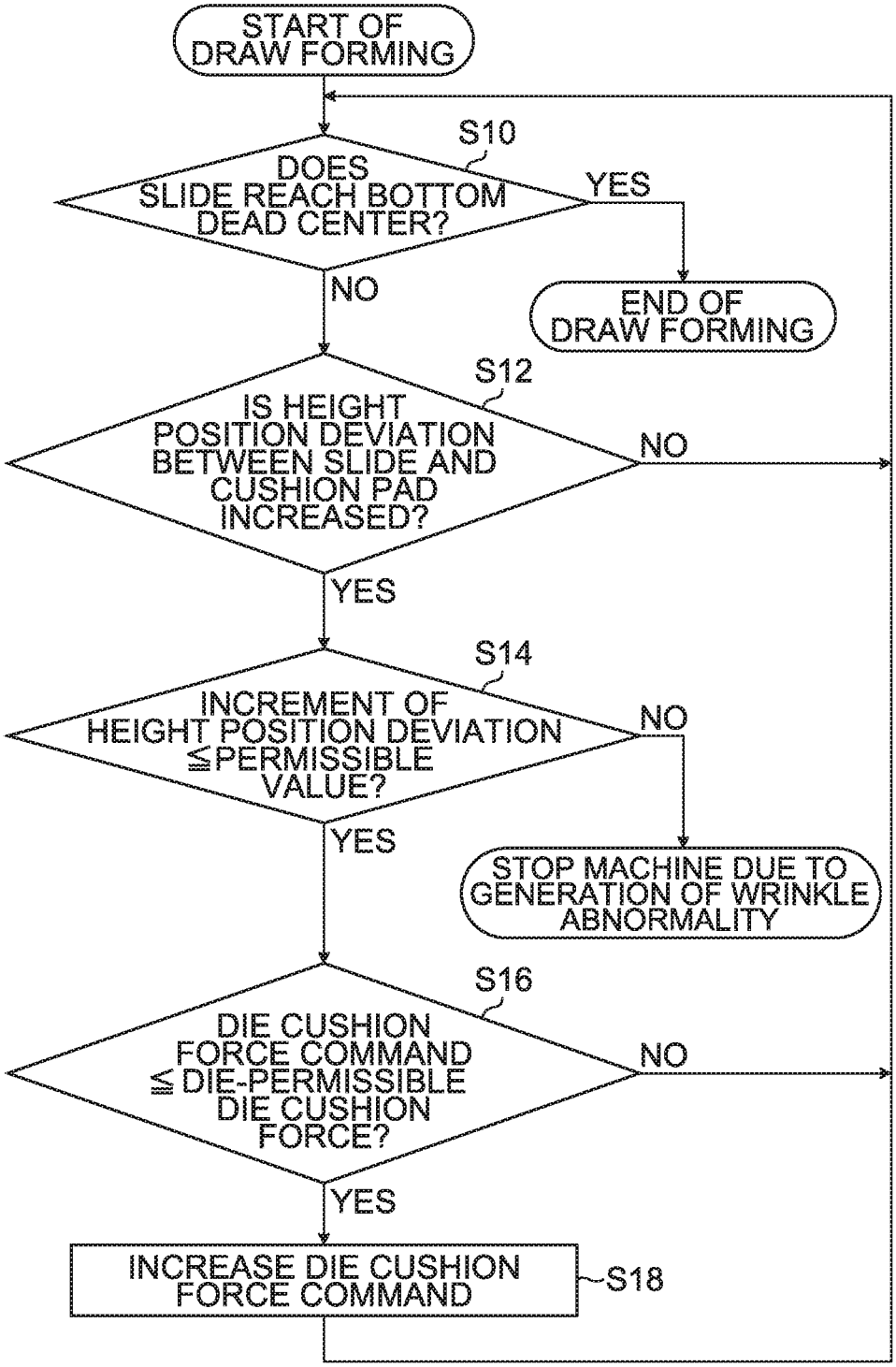
FIG. 9 is a flowchart illustrating an embodiment of a wrinkle generation detecting method and a die cushion force automatic setting method according to the present invention.

FIG. 9 is a flowchart illustrating an embodiment of a wrinkle generation detecting method and a die cushion force automatic setting method according to the present invention.

In FIG. 9, the die cushion device 200 is switched to the die cushion force control state at the time when the slide 110 collides against the material 203, and the die cushion force command unit 322 outputs the die cushion force command as the control target value of the die cushion force. Herewith, draw forming of the material 203 is started.

After the draw forming is started, the die cushion control device 300 determines whether the slide 110 reaches the bottom dead center (step S10).

In the case where the slide 110 reaches the bottom dead center (in the case of "Yes"), the draw forming of the material 203 is completed. The die cushion control device 300 is switched from the die cushion force control state to the cushion pad position control state, and performs the product knockout operation. In addition, the die cushion control device 300 outputs the cushion pad position command for controlling the height position of the cushion pad 210 in order that the cushion pad 210 is allowed to wait in a die cushion standby position, which is an initial position.

In the case where the slide 110 does not reach the bottom dead center (in the case of "No"), the computing unit 554 of the wrinkle generation detection device 550 (FIG. 4) calculates the height position deviation between the height position of the slide 110 and the height position of the cushion pad 210. The increase detector 552 determines whether the height position deviation is increased based on the height position deviation calculated by the computing unit 554 (step S12).

In the case where the height position deviation is not increased (in the case of "No"), the process proceeds to step S10, whereas in the case where the height position deviation is increased (in the case of "Yes"), the process proceeds to step S14.

In step S14, it is determined whether the increment of the height position deviation is less than or equal to the permissible value.

In the case where the increment of the height position deviation is less than or equal to the permissible value (in the case of "Yes"), the process proceeds to step S16. In the case where the increment of the height position deviation exceeds the permissible value (in the case of "No"), the die protection device 500 outputs the braking command to the press control device 400 such that the press machine 100 (slide 110) is suddenly braked through the press control device 400. This prevents a die breakage which would have been caused if the press machine 100 was continuously operated under the state where wrinkles were generated.

The permissible value may be appropriately set in accordance with the presence or absence of possibility that the increment of the height position deviation (the size of wrinkle generated in the material 203) breaks the die, or may be set as a threshold value used for sorting out defective products according to quality (the size of wrinkle, etc.) required for the products.

Meanwhile, in the case where the increment of the height position deviation is less than or equal to the permissible value (in the case of "Yes"), the die cushion control device 300 determines whether the present die cushion force command is less than or equal to a preset die-permissible die cushion force (step S16). Note that, the preset die-permissible die cushion force is a value previously set according to a die structure, etc.

In the case where the die cushion force command is less than or equal to the die-permissible die cushion force (in the case of "Yes"), the die cushion force command unit 322 which functions as the die cushion force automatic command unit increases by a fixed value the die cushion force command which is presently being outputted (step S18), and thereafter, the process proceeds to step S10.

Meanwhile, in the case where the die cushion force command exceeds the die-permissible die cushion force, the die cushion force command which is presently being outputted is maintained without increasing thereof and the process proceeds to step S10.

<Die Cushion Force Automatic Setting Method>

Figure 10:
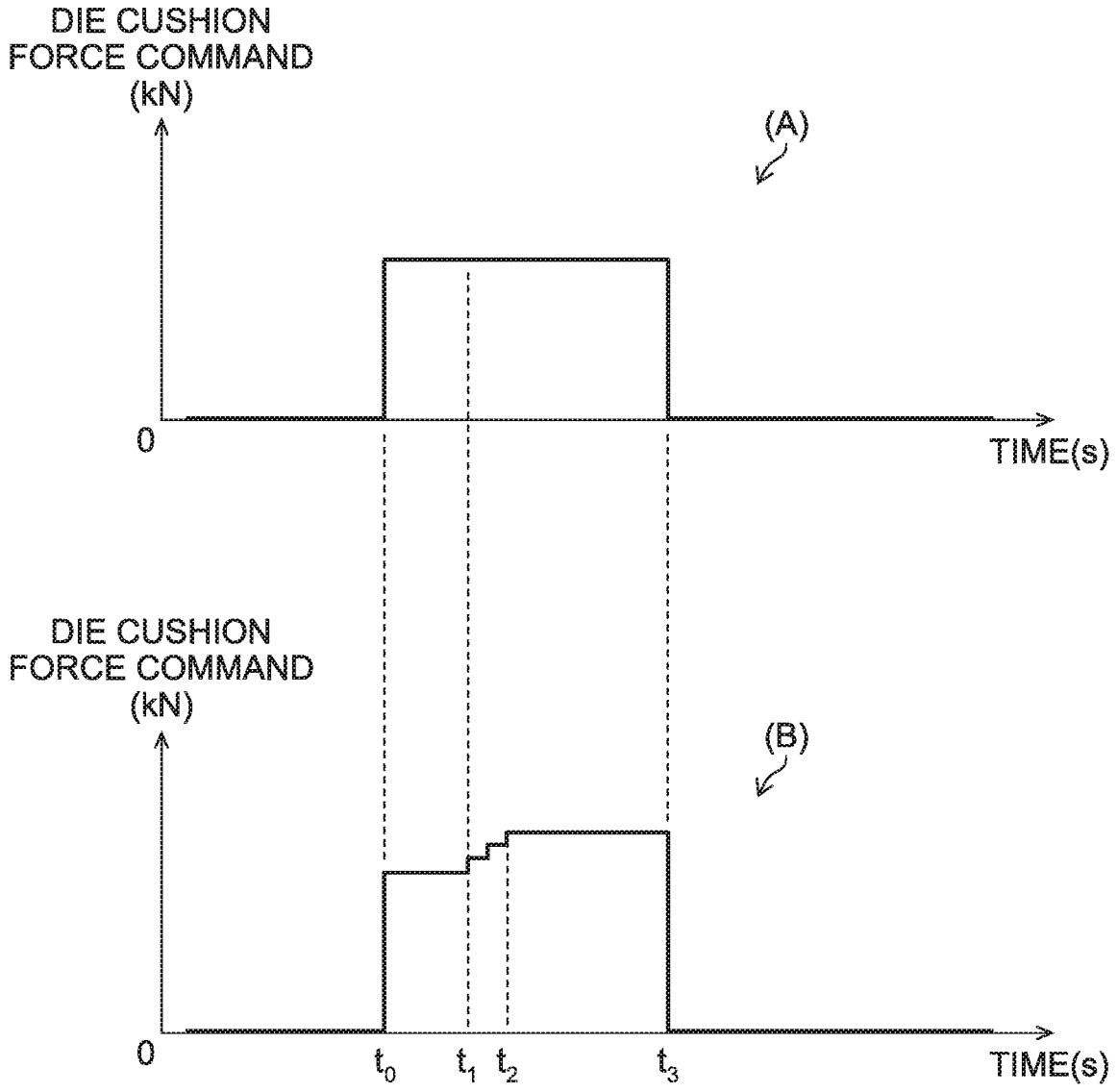
FIG. 10 is a diagram illustrating waveforms of examples of die cushion force commands set by the die cushion force automatic setting method according to the present invention, wherein Part (A) illustrates a preset die cushion force command and Part (B) illustrates a die cushion force command which is obtained by automatically adjusting the preset die cushion force command.

FIG. 10 is a diagram illustrating waveforms of examples of die cushion force commands set by the die cushion force automatic setting method according to the present invention. Part (A) in FIG. 10 illustrates the preset die cushion force command, and Part (B) in FIG. 10 illustrates a die cushion force command which is obtained by automatically adjusting (setting) the preset die cushion force command during the forming.

As shown in Part (A) in FIG. 10, the preset die cushion force command is a die cushion force command having a step-like shape (square wave) which is constant during a period from the starting time of forming ($t_0$) to the ending time of the forming ($t_3$).

Here, an increase of the height position deviation at the time point of time ($t_1$) is detected by the increase detector 552 of the wrinkle generation detection device 550, and in the case where the increment is less than or equal to the permissible value, then the die cushion force command being presently outputted is increased by a fixed value by the die cushion force command unit 322 which functions as the die cushion force automatic command unit.

From then on, an increase of the height position deviation is likewise detected, and in the case where the increment is less than or equal to the permissible value, then the die cushion force command being presently outputted is furthermore increased by a fixed value by the die cushion force command unit 322. In this way, the die cushion force command outputted from the die cushion force command unit 322 is stepwisely (gradually) increased from the time point of time ($t_1$).

Note that, it is preferable that the time interval of steps by which the die cushion force command is stepwisely increased is longer than or equal to the control sampling time for configuring digital control, and is shorter than or equal to the die cushion force response time. Further, inclination of the increased die cushion force command is determined by the time interval of steps by which the die cushion force command is stepwisely increased and the fixed value by which the die cushion force command is increased.

In the example shown in Part (B) in FIG. 10, during a period from time ($t_1$) to time ($t_2$), an increase of the height position deviation is detected and the increment is less than or equal to a permissible value. Therefore, during the period from the time ($t_1$) to the time ($t_2$), the die cushion force command is gradually increased. From the time ($t_2$) on, an increase of the height position deviation is not detected, and therefore, the die cushion force command is maintained at the same value as the die cushion force command set at the time ($t_2$).

In this way, the die cushion force command unit 322 which functions as the die cushion force automatic command unit automatically adjusts (sets) the preset die cushion force command during the forming, thereby preventing the height position deviation from being increased (i.e., wrinkles in the material 203 are not widened).

Note that, the die cushion force automatic setting method in which the die cushion force command is automatically set in this way during the forming, is effective when it is applied to a servo die cushion device which uses a servo motor 256 as shown in FIG. 1 and has high responsiveness of the die cushion force.

Further, it is preferable to output information on the slide position or the cushion pad position when the increase of the height position deviation is detected by the wrinkle generation detection device 550 and the die cushion force command increased by the die cushion force command unit 322 which functions as the die cushion force automatic command unit, to the display device 560 or the printer 562 via the input/output section 556 so that the output information may be visually displayed, or stored in the storage section 558 via the input/output section 556. This is because the information visually displayed or stored in the storage section 558 can be effectively utilized in adjusting the die cushion force, etc.

<Wrinkle Generation Detecting Method>

In the wrinkle generation detecting method according to the present invention, during a time period from the start of forming of the material 203 to the end of the forming, the height position of the slide 110 and the height position of the cushion pad are detected, and then, the deviation between the height position of the slide 110 detected and the height position of the cushion pad 210 detected is consecutively calculated. Then, based on an increase of the thus consecutively calculated height position deviation, a wrinkle generated in the material 203 is detected.

During a time period from the start of forming of the material 203 to the end of the forming, the height position deviation is consecutively calculated and an increase (increment) of the height position deviation is detected. Thereby, it is possible to obtain information on the slide position or the cushion pad position at a time point when at least an increase of the height position deviation is detected (at a time point when a wrinkle is initially generated).

In the embodiment shown in FIG. 9, in the case where the increment of the height position deviation is less than or equal to the permissible value and the die cushion force command is less than or equal to the die-permissible die cushion force, the die cushion force command is gradually increased within a range not exceeding the die-permissible die cushion force. However, it is not suitable for a die cushion device which has low responsiveness of the die cushion force.

In the die cushion device which has low responsiveness of the die cushion force, it is preferable that information on the slide position or on the cushion pad position at a time point when an increase of the height position deviation is detected, is visually outputted to the display device 560 or the printer 562 or stored in the storage section 558 as information so that an engineer may appropriately set the die cushion force command, etc. in accordance with the output or stored information.

Note that, in the embodiment shown in FIG. 9, when it is determined that the increment of the height position deviation exceeds the permissible value (when "No" in step S14), the die protection device 500 outputs the braking command to the press control device 400 such that the press machine 100 (slide 110) is suddenly braked through the press control device 400. Consequently, it is not possible to measure the increment of the height position deviation after the slide 110 is emergency stopped. However, it is possible to obtain at least information on the slide position or on the cushion pad position at a time point when an increase of the height position deviation is detected.

<Setting Example of Die Cushion Force Command>

Next, an example of the die cushion force command setting for adjusting (resetting) the die cushion force command based on information on the slide position or the cushion pad position at a time point when an increase of the height position deviation is detected will be described.

Figure 11:
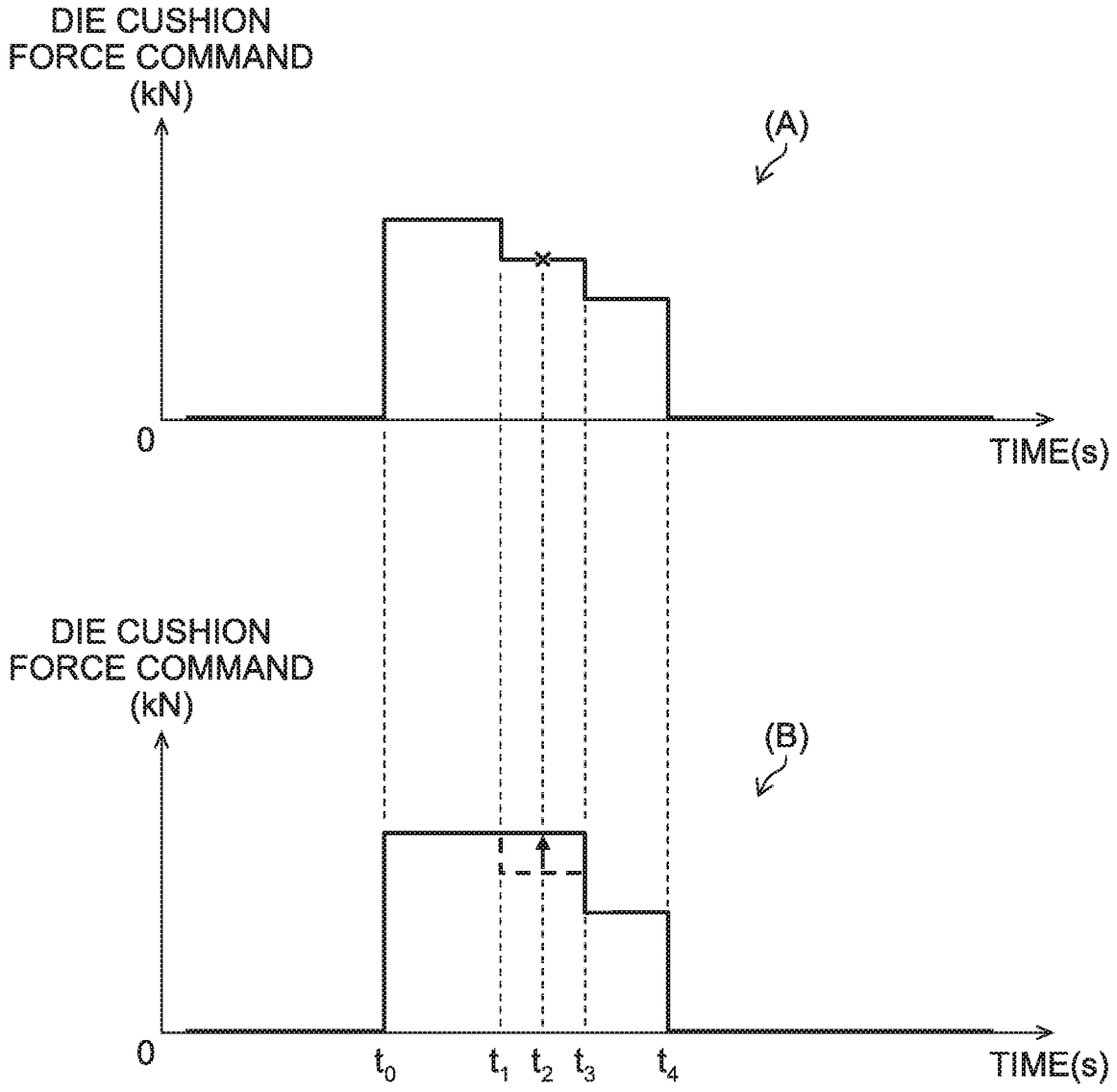
FIG. 11 is a diagram illustrating waveforms of die cushion force commands used to describe an example of die cushion force command setting for adjusting (resetting) die cushion force command.

Now, it is assumed that, as shown in Part (A) in FIG. 11, a die cushion force command is previously set in the die cushion force command unit 322 (FIG. 3), and the set die cushion force command is stepwisely changed at time ($t_0$), time ($t_1$), time ($t_3$), and time ($t_4$). Note that, time ($t_0$) is the start time of forming and time ($t_4$) is the end time of the forming.

In the case where the die cushion force of the die cushion device 200 is controlled based on the die cushion force command shown in Part (A) in FIG. 11, it is assumed that the increase of the height position deviation is detected by the wrinkle generation detection device 550 when the slide 110 reaches a slide position corresponding to time ($t_2$) that is intermediate between time ($t_1$) and time ($t_3$).

In this case, an engineer can confirm by the display device 560, etc., a slide position at time ($t_2$) when the increase of the height position deviation is detected by the wrinkle generation detection device 550. Accordingly, as shown in Part (B) in FIG. 11, it is possible to reset a die cushion force command so as not to generate wrinkles by increasing the die cushion force command for the interval from time ($t_1$) to time ($t_3$) including time ($t_2$) to be larger than the preset die cushion force command.

Note that, in the example shown in Part (B) in FIG. 11, the die cushion force command for the interval from time ($t_1$) to time ($t_3$) is increased to the same value as the die cushion force command for the interval from time ($t_0$) to time ($t_1$). However, it may be increased to a larger value or smaller value, than the die cushion force command in the interval from time ($t_0$) to time ($t_1$).

Further, in the case where the die cushion force of the die cushion device 200 is controlled based on the reset die cushion force command, if an increase of the height position deviation is again detected by the wrinkle generation detection device 550, then the die cushion force command for the interval including the slide position when a wrinkle is initially generated is similarly increased.

Thereby, the engineer can easily set the die cushion force command which can prevent generation of wrinkles.

Note that, in this example, an engineer resets the die cushion force command which can prevent generation of wrinkles. However, instead, of the engineer, the die cushion device 200 may automatically reset the die cushion force command set in the die cushion force command unit 322 according to the wrinkle detection result stored in the storage section 558.

[Other Embodiments of Die Cushion Device]

Figure 12:
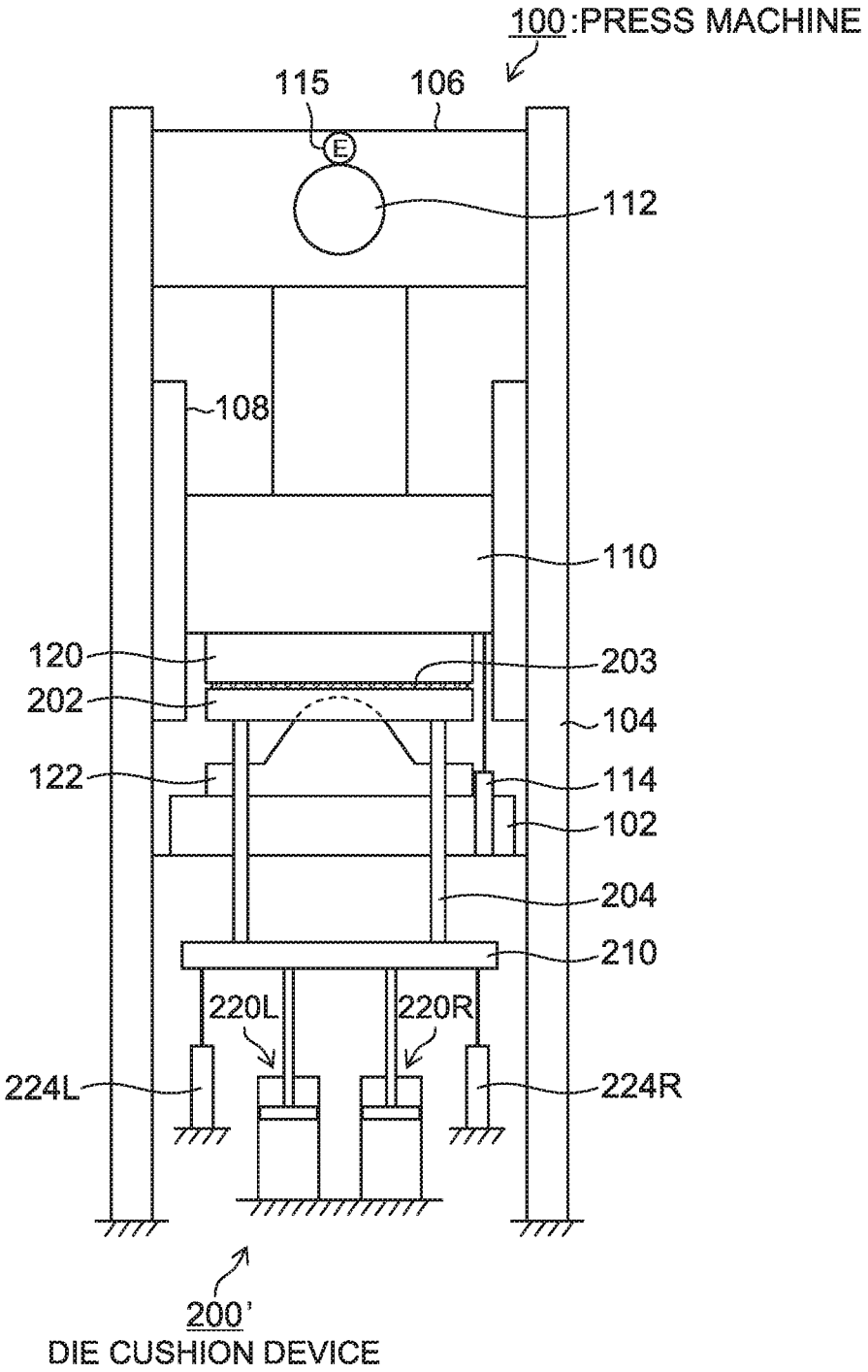
FIG. 12 is a configuration diagram illustrating a press machine of a second embodiment with a die cushion device to which a wrinkle generation detection device according to the present invention is applied.

FIG. 12 is a configuration diagram illustrating a press machine provided with a die cushion device of a second embodiment to which a wrinkle generation detection device according to the present invention is applied.

The die cushion device 200' of the second embodiment shown in FIG. 12 is different from the die cushion device 200 of the first embodiment (FIG. 1) mainly in that: the die cushion device 200 of the first embodiment has one hydraulic cylinder 220 and one cushion pad position detector 224, whereas the die cushion device 200' of the second embodiment has a pair of two hydraulic cylinders 220L, 220R and two cushion pad position detectors 224L, 224R each detecting corresponding left or right height position of a cushion pad 210.

Further, the die cushion device 200' of the second embodiment is provided with: hydraulic circuits which drive the hydraulic cylinders 220L, 220R independently from each other, and a die cushion control device which independently controls die cushion drive devices respectively including the hydraulic circuits. The die cushion control device controls the die cushion force caused by the hydraulic cylinders 220L, 220R independently from each other, and has die cushion force control units which are independent from each other.

The wrinkle generation detection device which is applied to the die cushion device 200' of the second embodiment can calculate, deviation (height position deviation) between the height position of the slide detected by one slide position detector 114 and the height positions at a plurality of spots (two spots in this example) of the cushion pad 210 detected by the cushion pad position detectors 224L, 224R at the plurality of spots (two spots), based on a slide position detection signal from the slide position detector 114 and two cushion pad position detection signals from the cushion pad position detectors 224L, 224R provided at the plurality of spots (two spots) in the cushion pad 210.

Accordingly, it is possible to detect the position on the material at which wrinkle is initially generated (for example, at one or both of left and right positions of the cushion pads 210 at which the pair of cushion pad position detectors 224L, 224R on right and left sides are provided) and the slide position when a wrinkle is initially generated.

Further, it is possible to individually reset respective die cushion force command set in the die cushion force command units separate from each other.

[Others]

A press machine having a die cushion device to which a wrinkle generation detection device according to the present invention is applied is not limited to the die cushion device and the press machine explained in the present embodiments. The wrinkle generation detection device according to the present invention is applicable to any press machine having a different die cushion device. Further, the number of hydraulic cylinders which move a cushion pad of a die cushion device up and down and the number of cushion pad position detectors are not limited to the present embodiments.

Further, the cushion pad position detector does not need to be placed at a position different from the hydraulic cylinder which moves the cushion pad up and down. The cushion pad position detector may be included in the hydraulic cylinder.

The die cushion force generator of the present embodiment includes the hydraulic cylinder for moving the cushion pad up and down, and the hydraulic motor and servo motor for driving this hydraulic cylinder. However, the die cushion force generator is not limited to this configuration and any configuration is possible insofar as it produces a die cushion force.

Further, the die cushion force command does not need to be a step-like die cushion force command which is stepwisely changed according to the slide position. That die cushion force command may be changed in a tapered manner correspondingly to the slide position, or may be a combination of that which is stepwisely changed and that which is changed in a tapered manner.

Furthermore, the present invention is not limited to the embodiments described above, and needless to say, various modifications can be made without departing from the spirit of the present invention.

What is claimed is:

1. A die cushion device which supports a cushion pad and generates a die cushion force when a slide of a press machine is lowered, the die cushion device comprising:

a die cushion force generator configured to generate the die cushion force in the cushion pad;

a die cushion force automatic command unit configured to output a preset die cushion force command;

a die cushion force controller configured to control the die cushion force generator such that the die cushion force is generated in the cushion pad based on the die cushion force command; and a wrinkle generation detection device comprising:

a slide position detector configured to detect a height position of the slide;

a cushion pad position detector configured to detect a height position of the cushion pad; and a computing unit configured to consecutively calculate a deviation between the height position of the slide detected by the slide position detector and the height position of the cushion pad detected by the cushion pad position detector, during a time period from a start of forming of a material by the slide lowering to an end of the forming, wherein a wrinkle generated in the material is detected based on an increase of the deviation consecutively calculated by the computing unit, wherein the die cushion force automatic command unit outputs a preset die cushion force command, wherein when an increase of the deviation is detected by the wrinkle generation detection device, the die cushion force automatic command unit increases the die cushion force command being presently outputted from a time point when the increase of the deviation is detected, wherein when the increase of the deviation is stopped, the die cushion force automatic command unit stops the increase of the die cushion force command from a time point when the increase of the deviation is stopped, and the die cushion force command is automatically reset, and wherein the slide is driven to obtain a predetermined slide velocity.

2. The die cushion device according to claim 1, wherein the die cushion force automatic command unit increases the die cushion force command being presently outputted within a range of a permissible die cushion force when the increase of the deviation is detected by the wrinkle generation detection device.

3. The die cushion device according to claim 1, further comprising an output section configured to visually output or a storage section configured to store, information on the position of the slide or the position of the cushion pad when the increase of the deviation is detected by the wrinkle generation detection device, and the die cushion force command increased by the die cushion force automatic command unit.

4. The die cushion device according to claim 1, further comprising:

an increase detector configured to detect the increase of the deviation calculated by the computing unit; and an emergency stop device configured to immediately stop the slide when the increase of the deviation is detected by the increase detector and the detected increment exceeds a permissible value.

5. A die cushion device comprising:

a die cushion force generator configured to generate a die cushion force in a cushion pad;

a die cushion force automatic command unit configured to output a die cushion force command;

a die cushion force controller configured to control the die cushion force generator such that the die cushion force is generated in the cushion pad based on the die cushion force command; and a wrinkle generation detection device for a press machine having the die cushion device which supports the cushion pad and generates the die cushion force when a slide of the press machine is lowered, the wrinkle generation detection device comprising:

a slide position detector configured to detect a height position of the slide;

a cushion pad position detector configured to detect a height position of the cushion pad; and a computing unit configured to consecutively calculate a deviation between the height position of the slide detected by the slide position detector and the height position of the cushion pad detected by the cushion pad position detector, during a time period from a start of forming of a material by the slide lowering to an end of the forming, wherein a wrinkle generated in the material is detected based on an increase of the deviation consecutively calculated by the computing unit, wherein the die cushion force automatic command unit outputs a preset die cushion force command, wherein when an increase of the deviation is detected by the wrinkle generation detection device, the die cushion force automatic command unit increases the die cushion force command being presently outputted from a time point when the increase of the deviation is detected, wherein when the increase of the deviation is stopped, the die cushion force automatic command unit stops the increase of the die cushion force command from a time point when the increase of the deviation is stopped, and the die cushion force command is automatically reset, wherein the slide is driven to obtain a predetermined slide velocity, wherein the cushion pad position detector is provided at each of a plurality of spots of the cushion pad and detects each of height positions at the plurality of spots of the cushion pad, and wherein the computing unit calculates each of deviations between the height position of the slide detected by the slide position detector and the height positions at each of the plurality of spots of the cushion pad detected by each cushion pad position detector.

6. The die cushion device according to claim 5, wherein the die cushion force automatic command unit increases the die cushion force command being presently outputted within a range of a permissible die cushion force when the increase of the deviation is detected by the wrinkle generation detection device.

7. The die cushion device according to claim 5, further comprising an output section configured to visually output or a storage section configured to store, information on the position of the slide or the position of the cushion pad when the increase of the deviation is detected by the wrinkle generation detection device, and the die cushion force command increased by the die cushion force automatic command unit.

8. The die cushion device according to claim 5, further comprising:

an increase detector configured to detect the increase of the deviation calculated by the computing unit; and an emergency stop device configured to immediately stop the slide when the increase of the deviation is detected by the increase detector and the detected increment exceeds a permissible value.

* * * * *